United States Patent [19]

Jennings

[11] Patent Number: 4,842,272

[45] Date of Patent: Jun. 27, 1989

[54] EXERCISE APPARATUS

[76] Inventor: Joe M. Jennings, 112 Sunset Dr., Hot Springs, Ark. 71913

[21] Appl. No.: 241,586

[22] Filed: Sep. 8, 1988

[51] Int. Cl.[4] ..... A63B 21/22; A63B 5/00

[52] U.S. Cl. ..... 272/132; 272/67; 128/25 R

[58] Field of Search ..... 272/131, 132, 71, 117, 272/118, 134, DIG. 4, 136, 72, 67; 128/25 R

[56] References Cited

U.S. PATENT DOCUMENTS

| | | | |
|---|---|---|---|
| 2,921,791 | 1/1960 | Berner | 272/117 |
| 3,640,527 | 2/1972 | Proctor . | |
| 3,721,438 | 3/1973 | Kusmer | 272/71 |
| 4,411,421 | 10/1983 | Hershberger . | |
| 4,563,003 | 1/1986 | Bugallo et al. . | |
| 4,611,807 | 9/1986 | Castillo . | |
| 4,749,182 | 6/1988 | Duggan . | |

*Primary Examiner*—Richard J. Apley
*Assistant Examiner*—S. R. Crow
*Attorney, Agent, or Firm*—Henderson & Sturm

[57] ABSTRACT

An exercise apparatus having a pair of arms which are rotatable about a horizontal axis permitting a user to grasp handles attached thereto and to windmill the user's arms so that the arms of the machine will rotate about an axis extending through the shoulder joint connected to the user's arms. An adjustable resistance mechanism is provided to allow the user to adjust the resistance to rotation of the arms. The arms on the machine are adjustable in length from the rotational axis to handgrips and an adjusting mechanism is also provided to adjust the distance of the rotational axis from the surface on which the user is standing.

7 Claims, 4 Drawing Sheets

EXERCISE APPARATUS

TECHNICAL FIELD

The present invention relates generally to an exercise machine and more specifically to an exercise machine for permitting the windmilling of a user's arms and having a predetermined resistance thereto to achieve physical exercise.

BACKGROUND ART

Exercise machines of all types and configurations have been developed for toning up muscles, losing weight, physical therapy or the like. For example, U.S. Pat. Nos. 3,640,527 to Proctor, 4,411,421 to Hershberger and 4,563,003 to Bugallo et al all show exercise machines designed to allow a user to reciprocate his or her arms for exercise purposes. U.S. Pat. Nos. 4,611,807 to Castillo and 4,749,182 to Duggan show exercise machines which allow the user to rotate the user's hands in a circular fashion for exercise purposes.

Many of these exercise devices are fine for exercising a particular part of the body but they tend to be so specialized that other exercise equipment is necessary for exercising other parts of the body. Consequently, there is a need for exercise equipment which will be useful to exercise a number of muscles at one time.

DISCLOSURE OF THE INVENTION

The present invention relates to an exercise apparatus having a pair of arms which are rotatable about a horizontal axis to permit a user to grasp handles attached thereto and to windmill the user's arms so that the arms of the machine will rotate about an axis extending through the shoulder joint which attaches to the user's arms. An adjustable resistance mechanism is provided to allow the user to adjust the resistance to rotation of the arms. The arms on the machine are adjustable in length from the rotational axis and an adjusting mechanism is also provided to adjust the distance of the rotational axis from the surface on which the user is standing.

An object of the present invention is to provide an improved exercise apparatus.

Another object of the present invention is to provide an exercise apparatus for allowing a user to windmill the user's arms while keeping the elbows straight and having a controlled resistance thereto.

A further object of the present invention is to provide an exercise machine of the aformentioned type which has an adjustment to adjust to the arm length of any user.

A still further object of the present invention is to provide an apparatus of the aformentioned type which has an adjustment to adjust for the height of the user to position the rotational axis of the arms through the shoulder joints of the user.

A still further object of the present invention is to provide a handle apparatus on the aforementioned exercise apparatus which permits windmilling of the arms of the user without twisting of the wrists of such user.

Other objects, advantages, and novel features of the present invention will become apparent from the following detailed description of the invention when considered in conjunction with the accompanying drawings.

BEST MODE FOR CARRYING OUT THE INVENTION

Figure 1:
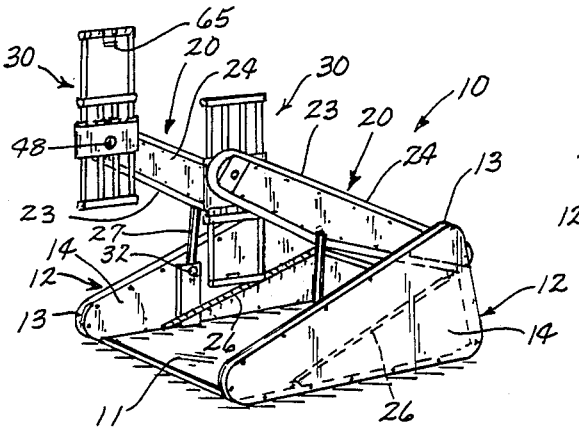
FIG. 1 is a perspective view of a preferred embodiment of the present invention.
Figure 2:
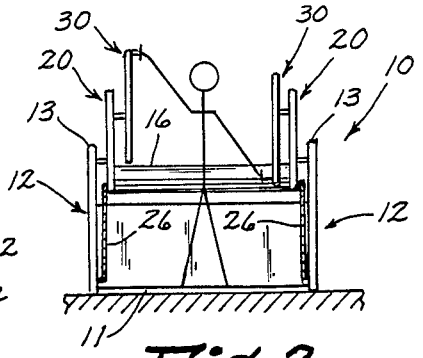
FIG. 2 is a front view showing a person in schematic lines using the exercise machine.
Figure 4:
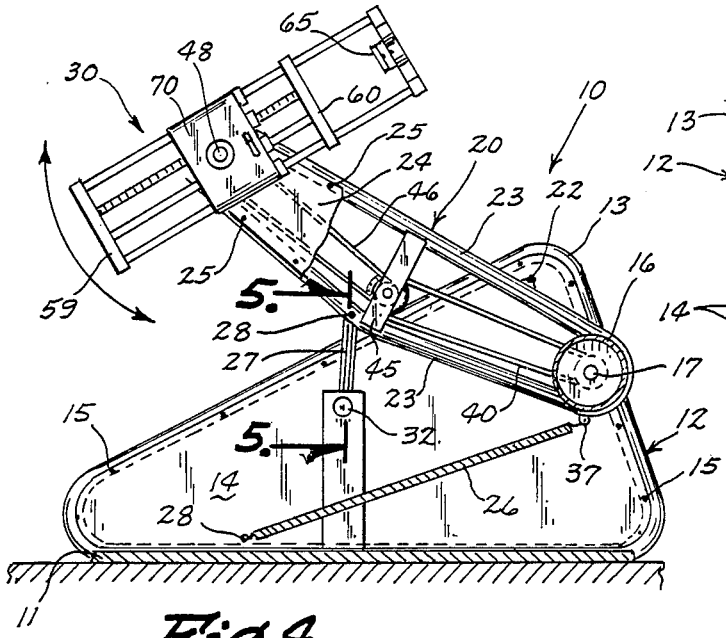
FIG. 4 is a cross-sectional view taken along line 4—4 of FIG. 3.

Referring now to the drawings wherein like reference numerals designate identical or corresponding parts throughout the several views, FIG. 1 shows an exercise machine (10) constructed in accordance with the present invention. Referring to FIG. 4, it is noted that the exercise machine (10) includes a base having a floor engaging plate (11) having upstanding side elements (12) attached thereto. These side elements (12) are constructed of tubing (13) around the outside and metal plates (14) rigidly affixed to the pipe (13) by fasteners (15).

Support members (20) are pivotally attached to upright base structures (12) by a pin arrangement (22). The support members (20) are constructed of a tube (23) having side metal plates (24) attached thereto by fasteners (25). These support members (20) have one end biased downwardly by a tension spring (26) attached at one end (37) to the support member (20) and at the other end (28) to the base (11). These two springs (26) will tend to cause the end with the arms (30) thereon to be up but the tension forces on the springs (26) can be overcome to move the end with the arms (30) thereon downwardly.

Figure 5:
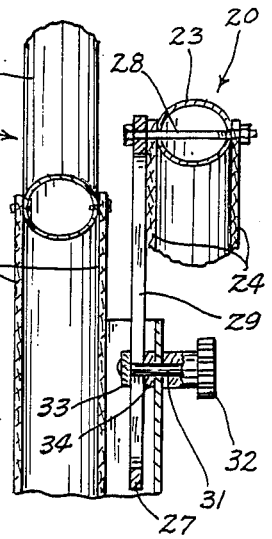
FIG. 5 is an enlarged partial cross-sectional view taken along line 5—5 of FIG. 4.

Referring to FIGS. 4 and 5, it is noted that a strap (27) is pivotally mounted by pin (28) to the tube (23) and a slot (29) in the strap (27) has a threaded fastener (31) extending therethrough. This threaded fastener (31) has a handle (32) thereon which can be rotated in one direction to tighten the strap (27) securely against washers (33) and (34) which will have the effect of holding the support members (20) in the desired position about the pivotal axis (22).

Figure 6:
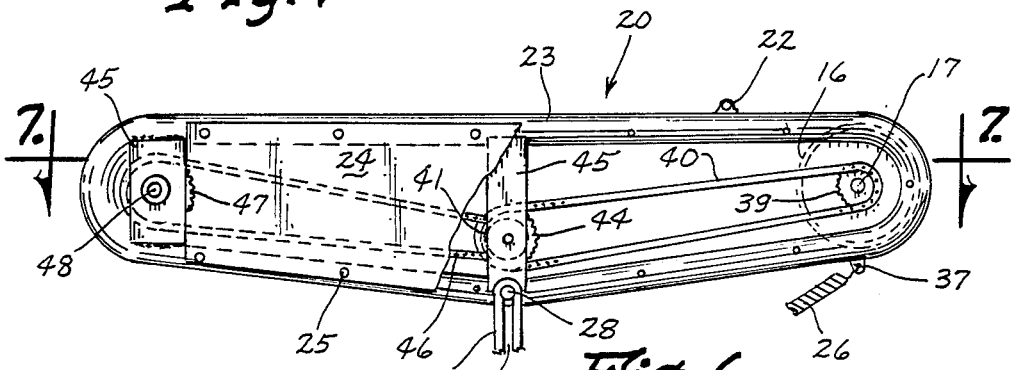
FIG. 6 is a cross-sectional view taken along line 6—6 of FIG. 3 and having a portion broken away to show the resistance chain structure disposed thereunder.
Figure 7:
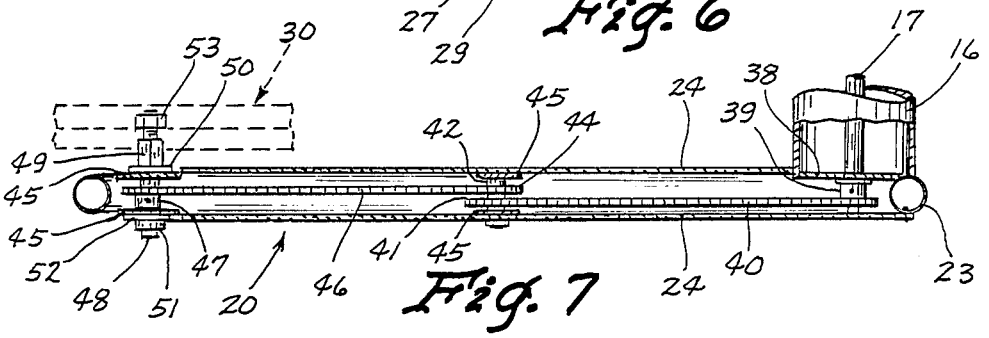
FIG. 7 is a cross-sectional view taken along line 7—7 of FIG. 6.

Referring now to FIGS. 6 and 7, it is noted that the support members (20) have a tubular housing (16) rigidly attached thereto and a shaft (17) is rotatably attached through a plate (38). A sprocket (39) is rigidly attached to the end of the shaft (17) and has a chain (40) extending thereover. The chain (40) also extends over a sprocket (41) rigidly attached to idler shaft (42). Another sprocket (44) is also rigidly attached to the idler shaft (42) and the idler shaft (42) is rotatably mounted to metal plates (24) through bearings plates (45). It will also be understood that instead of rigidly attaching sprockets (41) and (44) to a rotatable shaft (42) that, alternatively, the sprockets (41) and (44) could merely be rigidly attached together and placed in a rotatable fashion on a fixed shaft (42).

Figure 10:
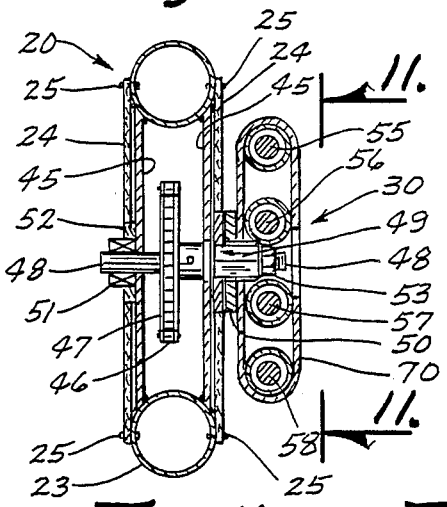
FIG. 10 is a cross-sectional view taken along line 10—10 of FIG. 3.

Another chain (46) extends over a sprocket (47) which is rigidly attached to a shaft (48). Fastener (49) holds a washer (50) in place and another threaded nut (51) holds the other end of the shaft (48) against a washer (52) so that the shaft (48) will be held in place on the support members (20). A threaded nut (53), shown in FIGS. 7 and 10, connects the arm (20) to the shaft (48) for allowing the arm (30) to be rotatable about the axis of the shaft (48).

Figure 11:
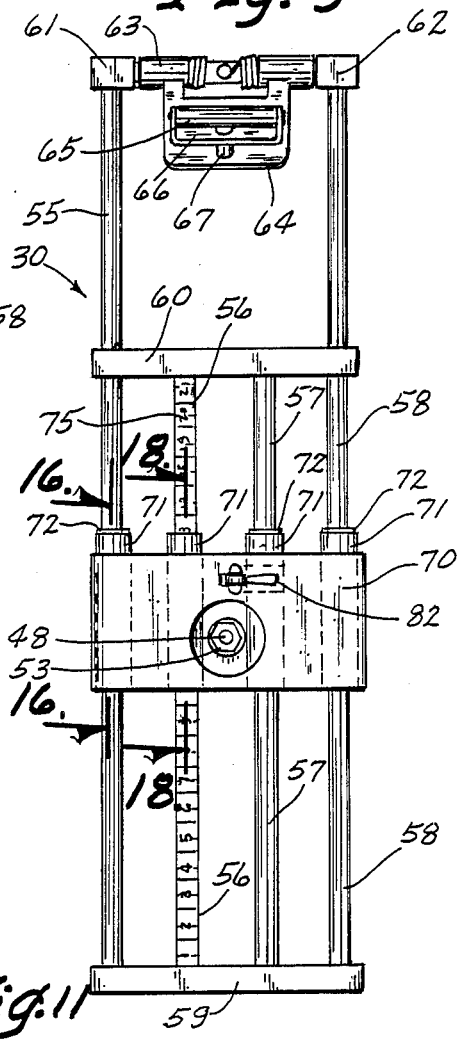
FIG. 11 is a side elevational view of one of the arms which are rotated about a horizontal axis.

Referring now to FIG. 11, it is noted that the rotatable arm (30) includes a plurality of bars (55), (56), (57) and (58) connected at one end thereof rigidly by a bar (59) and at an intermediate portion by a bar (60). The bars (55) and (58) extend upwardly to bearing members (61) and (62) for rotatably attaching a bar (63) thereto. The bar (63) has a plate (64) welded thereto and a handle (65) is rotatably mounted along its longitudinal axis to a U-shape member (66) and the U-shape member (66) is rotatably mounted to the plate (64) by a shaft (67)

Figure 16:
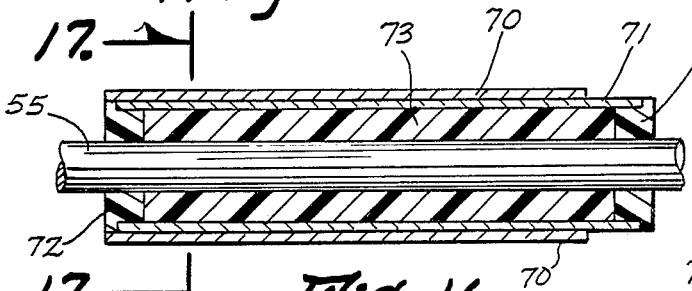
FIG. 16 is a cross-sectional view taken along line 16—16 of FIG. 11.
Figure 17:
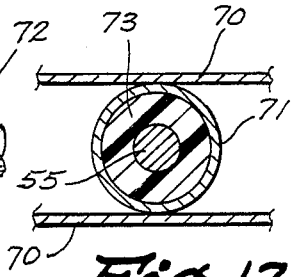
FIG. 17 is a cross-sectional view taken along line 17—17 of FIG. 16.
Figure 18:
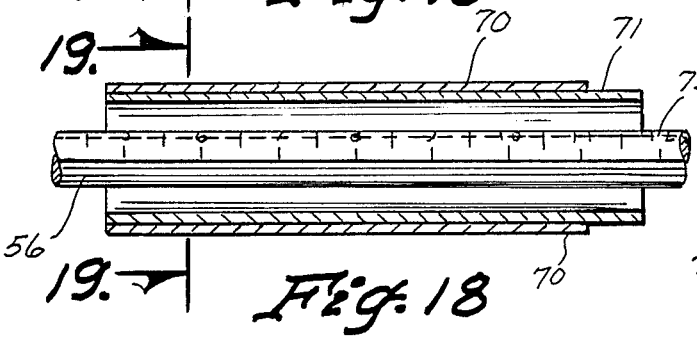
FIG. 18 is a cross-sectional view taken along line 18—18 of FIG. 11.
Figure 19:
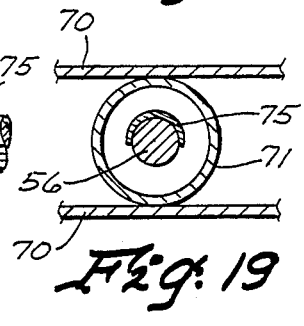
FIG. 19 is a cross sectional view taken along line 19—19 of FIG. 18.

A sheet metal portion (70) is rigidly attached to tubes (71) having caps (72) on each end thereof and a material (73) (FIGS. 16 and 17) inside the cylinders (71) which permit the assembly (70–73) to slide up and down along the bars (55–58). The shaft (56) has indicia (75) thereon to indicate the length of the arms from the pivot of shaft (48). The indicia (75) is shown in strip form on FIGS. 18 and 19.

Figure 13:
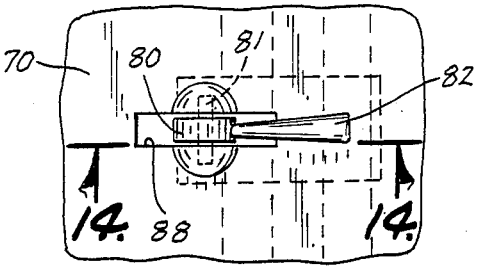
FIG. 13 is an enlarged view of an over center locking mechanism for adjusting the distance of the handle from the rotational axis of the arms.
Figure 14:
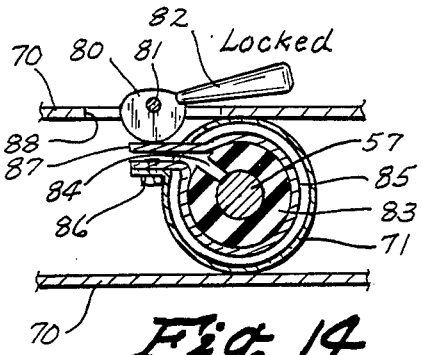
FIG. 14 is an enlarged partial cross-sectional view taken along line 14—14 of FIG. 13 and showing the arm locked in position at whatever predetermined length is desired.
Figure 15:
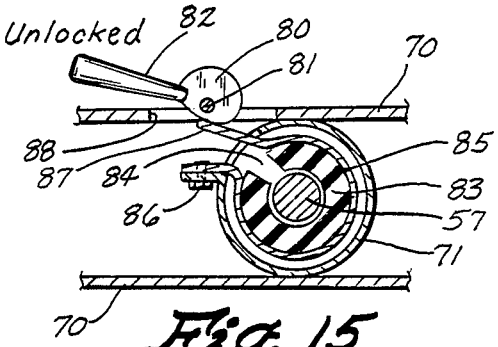
FIG. 15 is a view like FIG. 14 but showing the arm length adjusting mechanism in an unlocked position so that the distance of the handle from the rotational axis of the arm can be adjusted.

Referring to FIGS. 13–15, it is noted that a cam (80) is pivotally attached by a shaft (81) to the sheet metal (70) and the cam (80) has a handle (82) rigidly attached thereto. A strip of rubber or other plastic material (83) having a slit (84) on one side thereof is wrapped around the shaft (57) and a metal strap (85) is rigidly attached to the member (71) by fastener (86) and has a free end (87).

The metal strap (85) is biased to the position shown in FIG. 15 wherein the resilient rubber (83) is allowed to expand which allows the shaft (57) to freely move within the rubber (83), but when the handle (82) is moved from the unlocked position shown in FIG. 15 to the locked position shown in FIG. 14, then the cam (80) pushes down on the free end (87) of the strap (85) which squeezes the rubber (83) against the shaft (57) thereby preventing the shaft (57) from sliding within the rubber member (83). This has the effect of locking the sheet metal portion (70) with respect to the shaft (57) as can be seen in FIG. 11.

Figure 3:
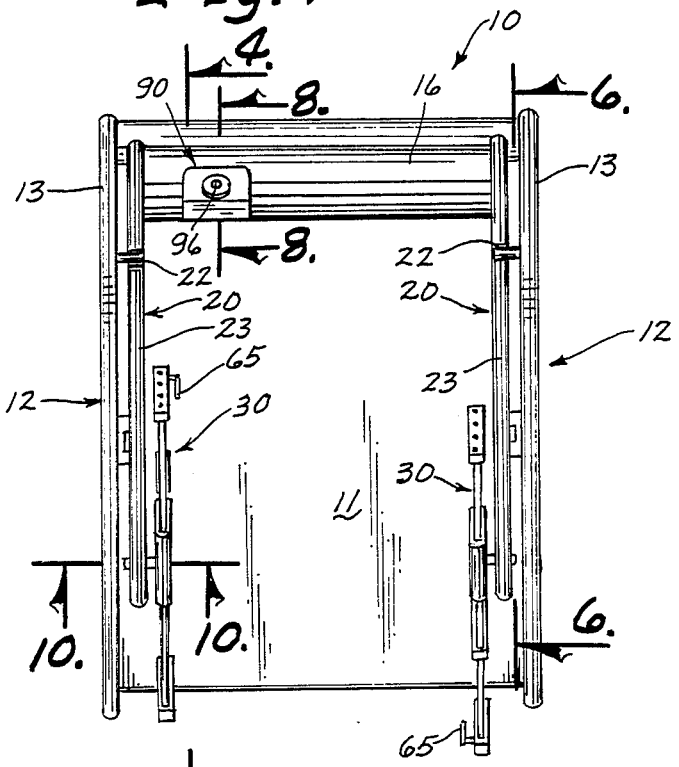
FIG. 3 is an enlarged top view of the machine shown in FIG. 1.

Referring to FIGS. 3 and 4, it is noted that the cylinder (16) is welded at each end thereof to the arm members (20) so that the support members (20) will pivot up and down together when adjusted by the adjusting knob (32) attached to plate (89). The support members (20) on each side are substantially identical or at least a mirror image of one another as are the arms (30).

Figure 8:
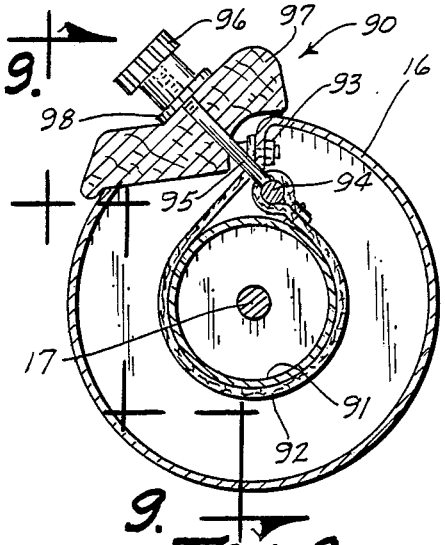
FIG. 8 is an enlarged partial cross-sectional view taken along line 8—8 of FIG. 3.
Figure 9:
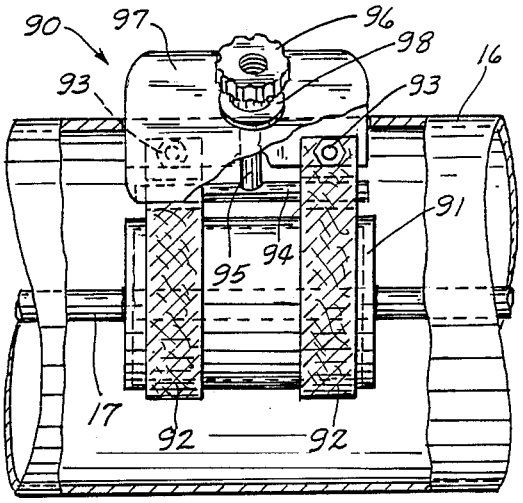
FIG. 9 is an enlarged partial cross-sectional view taken along line 9—9 of FIG. 8.
Figure 12:
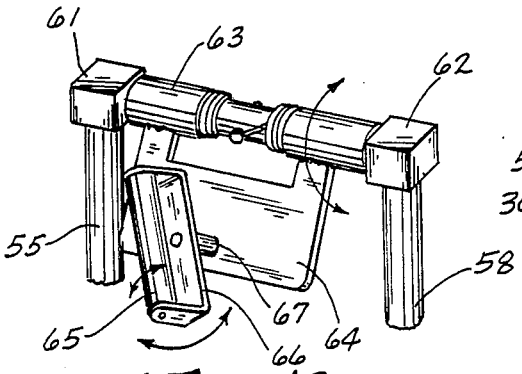
FIG. 12 is an enlarged perspective view showing how the handle is rotatably attached to the arm of FIG. 11 about two different pivotal axes.

Inside of the cylindrical housing (16) is the shaft (17) as can be seen in FIGS. 8 and 9. This shaft (37) has a drum (91) rigidly attached thereto and a pair of nylon belts (92) extending around the drum (91).

One end of the straps (92) are bolted by threaded fasteners (93) to the cylindrical housing (16). The other ends of the straps (92) are connected to a bar (94) which is rigidly connected to a shaft (95). This shaft (95) has a threaded top thereon for receiving a threaded handle (96). This threaded handle extends over a wooden spacer plate (97) and a washer (98). Consequently, when the handle (96) is rotated in one rotational direction, the shaft (94) and (95) will move up toward the washer (98) and the straps (92) will tighten against the drum (91) to make the shaft (37) resist rotation more. Inversely, when it is desired to allow the shaft (37) to rotate with less resistance, then the handle (96) is rotated in an opposite direction, which will cause the shafts (95) and (94) to move downwardly and loosen the straps (92) on the exterior of the drum (91).

In operation, a user would stand on the base plate (11) and first adjust the height of the axis about the shaft (48) about which the arms (30) rotate on the support member (20) so that this axis extends approximately through the shoulder joints of the user. This adjustment would be made by first loosening the knob (32) shown in FIG. 5, and then either pulling down on the upper end of the support members (20) or allowing the springs (26) to move the upper end in an upward direction. Once a proper height of the shaft (48) has been achieved, the handle (32) shown in FIGS. 4 and 5 would be tightened down to hold the support members (20) from further movement.

The next step would be to adjust the distance between the handle members (65), shown in FIG. 11, and the axis of the shaft (48) to coincide with the distance between the shoulder joint and the person's hand while holding the arm straight with the elbow locked.

The cam (80), shown in FIG. 15, would be loosened during this adjustment so that the arm (30) could move with respect to the metal housing (70). Once the arm adjustment length has been properly adjusted, then the cam (80) is moved to the locked position of FIG. 14 which prevents further sliding movement of the shafts (55–58) with respect to the metal housing (70). The user can then also note on the indicia (75), shown in FIGS. 18 and 19), so that the next time the machine is used, the user merely set it at the indicia mark and no further measurement is necessary.

The user is then able to grasp one of the handles (65) with one hand and the other of the handles (65) with the other hand, noting that the handles are locked 180° out of phase so that when the user grasps the handles (65), and the arms (30) are in the position shown in FIGS. 1 and 2, one of the user's arms will extend directly up and the other of the user's arm will extend directly down. The user can then begin to windmill the user's arms with both arms going in the same direction. The arms can be moving forwardly or rearwardly, clockwise or counterclockwise, but such arms must both be moving in the same general rotative direction. For example, they can first be moved in a clockwise direction for a while and then the machine could be stopped and the arms could be rotated in a counterclockwise direction to obtain more benefit therefrom. Such use exercises more than just the arms and shoulders, since during such use the hips of the user necessarily shift back and forth as well.

If as the user begins to use the exercise apparatus (10) it becomes apparent that the forces resisting rotation of the arms (30) is either too great or too little, then the user can adjust the knob (96) in one rotative direction to cause more resistance or in the other rotative direction to cause less resistance to rotation. It will be of course understood that the shaft (17), shown in FIGS. 8 and 9, extends across and between the entire circular housing (16) and connects to the sprocket and chain arrangement on both of the support arms (20). As the shaft (48) is turned, for example as shown in FIG. 7, that will turn the sprocket (47) and chain (46), which through sprocket (44) will turn the sprocket (41) and thereby the chain (40). The chain (40) will then cause the sprocket (39) to rotate which will, in turn, cause the shaft (17) to rotate accordingly. It has of course already been explained that the resistance to rotation of shaft (17) can be adjusted by using the adjusting mechanism (90) shown in FIGS. 8 and 9.

It is therefore clear that the preferred embodiment shown does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. An exercise apparatus comprising:

a base;

a first support member attached to said base;

a second support member attached to said base, the second support member being spaced from said first support member;

a first arm;

means for rotatably attaching said first arm to said first support member about a substantially horizontal axis;

a second arm;

means for rotatably attaching said second arm to said second support member about a substantially horizontal axis;

first handle means operably attached to one end of said first arm for permitting a person to hold onto the first handle means;

second handle means operably attached to one end of said second arm means for permitting a person to hold onto said second handle means;

resistance means for resisting the rotation of said first and second arms;

the distance between said first handle means and said first substantially horizontal axis being substantially the average length of a human arm;

first means for pivotally attaching said first handle means to said one end of said first arm for allowing pivoting of said first handle means with respect to said first arm about at least two axes, whereby a user can grasp said first handle means with one hand and keeping the respective elbow straight can rotatably windmill the respective arm 360° about the respective shoulder joint thereof; and second means for pivotally attaching said second handle means to said one end of said second arm for allowing pivoting of said second handle means with respect to said second arm about at least two axes, whereby a user can grasp said second handle means with one hand and keeping the respective elbow straight can rotatably windmill the respective arm 360° about the respective shoulder joint thereof; and transmission means for synchronizing the rotation of said arms.

2. The apparatus of claim 1 wherein the distance of said first handle means from the horizontal axis that said first arm is rotatably attached about and the distance of said second handle means from the horizontal axis that said second arm is rotatable about are both approximately the length of an average adult human's arm.

3. The apparatus of claim 1 including means for adjusting the distance of said first handle means from the horizontal axis that said first arm is rotatably attached about and the distance of said second handle means from the horizontal axis that said second arm is rotatable about.

4. The apparatus of claim 1 wherein said horizontal axes are generally parallel.

5. The apparatus of claim 4 including means attached to said base for adjusting the distance between the horizontal axis about which both of said first and second arms are rotatable and said base, whereby the horizontal axis can be adjusted to be at the same height as the joints between the shoulders and the arms of the user.

6. The apparatus of claim 1, including means associated with said resistance means for adjusting the amount of resistance of said resistance means whereby the user can change the amount of resistance to the windmilling of the user's arms.

7. The apparatus of claim 6, said transmission means includes means for holding said first and second arms substantially 180° out of phase.

* * * * *